United States Patent [19]

Hsueh et al.

[11] 4,045,084

[45] Aug. 30, 1977

[54] IN-SITU MINING OF COPPER AND NICKEL

[75] Inventors: Limin Hsueh, Bedford; Robert A. Hard, Still River; Donald H. Davidson, Bedford; Ray V. Huff, Acton, all of Mass.

[73] Assignee: Kennecott Copper Corporation, New York, N.Y.

[21] Appl. No.: 724,547

[22] Filed: Sept. 20, 1976

[51] Int. Cl.[2] ..... E21B 43/28

[52] U.S. Cl. ..... 299/4; 175/69

[58] Field of Search ..... 299/4, 5; 175/69; 75/101 R

[56] References Cited

U.S. PATENT DOCUMENTS

| | | | |
|---|---|---|---|
| 3,498,674 | 3/1970 | Matthews | 299/5 X |
| 3,708,206 | 1/1973 | Hard et al. | 299/5 |
| 3,937,520 | 2/1976 | Sievert | 299/4 |
| 3,999,803 | 12/1976 | Coursen | 299/4 |

*Primary Examiner*—Ernest R. Purser
*Attorney, Agent, or Firm*—Anthony M. Lorusso; John L. Sniado

[57] ABSTRACT

A process is disclosed for in-situ mining of copper from a subterranean ore body characterized, at least in part, by the presence of a sulfidic ore and by natural, microscopic fracture openings. The process comprises forcing a stable, two-phase lixiviant comprising an aqueous phase, a multiplicity of gaseous, oxygen-containing bubbles having a size sufficient to pass through the natural fracture openings in the ore body, and a surfactant for enhancing the formation of the bubbles and for minimizing bubble coalescence through the ore body to leach copper.

The aqueous and gaseous phases of the lixiviant are mixed at the surface and injected into the leaching interval through an injection hole, or preferably, are mixed in a subterranean sparger within the hole above the leaching interval. The pregnant liquor is recovered through one or more production holes and, after the copper is recovered, the lixiviant may be reconstituted and recirculated.

11 Claims, 7 Drawing Figures

IN-SITU MINING OF COPPER AND NICKEL

BACKGROUND OF THE INVENTION

This invention relates to a process for in-situ mining of copper and nickel from a deep subterranean ore body using a stable, two phase lixiviant. More specifically, it relates to a modification of the process set forth in copending patent application Ser. No. 724,548 entitled *In-Situ Mining Method and Apparatus* filed on even date herewith, the teachings of which are incorporated herein by reference.

There is known to be located through out various regions of the globe, large, deep lying deposits of copper in the form of low grade porphyry ores. A porphyry deposit is one in which the copper bearing minerals occur in disseminated grain and/or in veinlets through a large volume of rock such as schist, silicated limestone, and volcanic rock. Acid igenous intrusive rocks are usually in close association. The deposits are typically large tonnage but low grade, and have an average copper concentration of less than about 1 percent. Copper minerals found in these deposits are usually sulfides and most commonly are chalcopyrite. There are also massive sulfide deposits treatable by the present invention which are deep seated and contain discrete blebs of nickel sulfide, copper sulfide, or copper-nickel sulfide in association with iron sulfide. A representative list of minerals which can be treated to recover copper using the process of this invention includes chalcocite, digenite, covellite, pentlandite, heazlewoodite, vaesite, and violarite.

When a deposit of the type described is of sufficiently high grade and outcrops on the surface or is sufficiently close to the surface, the ore may be mined by open pit methods, and the metal values separated from the gangue constituents by techniques such as floatation.

Deeply buried or very low grade copper deposits cannot be easily exploited. Conventional open pit mining is not available because the costs involved are prohibitive and because landscape destructive open pit mining techniques have been restricted in many areas.

It has been proposed to extract the copper from the deeply buried porphyry deposits by in-situ leaching techniques. With in-situ mining, a hole is drilled and a leach liquor is pumped down the hole into the ore containing the metal to be recovered. After the liquor has leached the metal values, it is brought back to the surface and the values are recovered.

There are many prior art procedures for in-situ mining. Most of these procedures, however, involve rubblizing the ore which is to be leached by explosive methods. In contrast, the process and apparatus disclosed in the aforementioned copending Ser. No. 724,548 and the instant invention involve leaching the copper in-situ, without rubblizing the ore by employing a two-phase lixiviant comprising very small oxygen containing gas bubbles admixed with leach liquor. For this method to be successful, the oxygen containing bubbles must be small enough to penetrate the natural fracture openings within the rock so that the sulfidic minerals may be oxidized. Thereafter, the leach liquor solubilizes the metal values.

Prior to the present invention and prior to the process disclosed in the aforementioned copending U.S. Ser. No. 724,548 two-phase lixiviants useful for such purposes, although theoretically desirable, were thought to be unattractive for a number of reasons. The two primary problems were the size of the bubbles and the difficulties stemming from phase separation, i.e., formation of gas pockets. So severe were the problems associated with such two-phase in-situ mining procedures, that research in this area has been discouraged.

The types of copper and nickel bearing ores with which the present invention is concerned generally have a porosity of about 3% and are found on the order of 2,000 feet below the surface. The cracks, pores, and other fracture openings in these rocks usually have dimensions on the order of 10 to 300 microns. Since these openings contain the metal values of interest, and since the sulfidic minerals in which the metal values are contained must be oxidized before the leach liquor can take effect, it is necessary that the lixiviant contain a high concentration of oxygen containing bubbles small enough to move freely through the openings. The ideal lixiviant would comprise a leach liquor containing a high concentration of oxygen in the form of stable bubbles having a diameter less than about 10 microns. It is also desirable that the lixiviant have a viscosity at the temperature of use cf close to 1.0 centipose.

In practice, as mentioned above, such a two-phase lixiviant has been difficult to produce and even more difficult to maintain. Methods are known for forming small bubbles in a liquid, but in the known two-phase systems, the bubbles tend to coalesce, form larger bubbles, and ultimately form large pockets of gas. The higher the viscosity of the liquid phase, the easier it is to form bubbles of the size described and to maintain them. In systems using low viscosity compounds with the high volume fraction of gas, i.e. higher than 15–30%, production and maintenance of small gas bubbles becomes very difficult. Another variable which affects the stability of gas bubbles in a two-phase system is the flow rate of the lixiviant. Generally, it has been observed that the higher the flow rate, the easier it is to maintain the gas-liquid dispersion. However, in use, there is an upper limit in the flow rate which limit makes unavailable any advantage which might theoretically be gained by employing a high flow rate. When deterioration of the two-phase system occurs in the in-situ mining procedure such as that disclosed in the aforementioned copending application, a two-phase lixiviant is rendered inoperative or unacceptably inefficient.

SUMMARY OF THE INVENTION

The present invention provides an in-situ mining process which utilizes a stable, two-phase lixiviant suitable for mining copper and nickel contained in sulfidic ore deposits characterized by natural microscopic fracture openings. The lixiviant comprises an aqueous leach liquor phase, a multiplicity of oxygen containing bubbles having a size, when subjected to the pressure employed during the in-situ mining, sufficient to pass through the fracture openings in the ore formation and a surfactant for maintaining the size and individuality of the bubbles and for enhancing the mass transfer rate of oxygen to the metal values of interest. In preferred embodiments of the process of the invention, the bubbles in the lixiviant are less than 10 microns in diameter.

Surprisingly, it has been discovered that many surfactants, when added to the liquor phase prior to introduction of the bubbles, greatly increases the stability of bubbles formed, enables smaller bubbles to be formed, and tends to maintain the size of the smaller bubbles for a substantial time during the mining procedure. In addition to the surfactant, the lixiviant may include aluminum ions for further minimizing coalescence of the bubbles and an agent to increase solubilization of $Ca^{++}$ ions which are often present in ore formations.

The term "surfactant" as used herein is an abbreviated term for "surface active agent." A surfactant is any compound that usually reduces surface tension when dissolved in water or water solutions, or which similarly affects interfacial tension between two liquids. Soap is such a material but the term is more frequently applied to organic derivatives such as sodium salts of high molecular weight alkyl sulfates, alkyl sulfonates and other organic derived surfactants as further described herein.

The addition of one or more surfactants to the lixiviant also imparts increased wetting ability of the mineral surfaces as well as reducing bubble size and increasing the intersurface area. Still further, the surfactant's known ability to reduce surface tension tends to enhance the mass transfer rate of oxygen with the ore of interest. The preferred aqueous phase comprises an ammoniacal leach liquor, although, as will be set forth below, other aqueous phases are contemplated for certain applications.

In accordance with the invention, an injection hole and at least one recovery hole are drilled to provide communication with the ore body. The stable, two phase lixiviant is then forced through the ore body under pressure, the oxygen bubbles passing through the fracture openings and oxidizing the sulfidic minerals. The copper and/or nickel ions are solubilized in the aqueous phase and recovered through the recovery hole. Copper and/or nickel metal may then be recovered from the pregnant liquor by conventional techniques. The two phases of the lixiviant may be put together either at the well head or, preferably, at a point well below ground level close to the leaching interval. In this latter regard, see copending U.S. application Ser. No. 724,549 entitled "In Situ Method and Apparatus for Sparging Gas Bubbles" filed on even date herewith, the disclosure of which is incorporated herein by reference.

In the process disclosed in U.S. application Ser. No. 724,548, apparatus is employed adjacent the bottom of the injection hole at the leaching interval to minimize separation of the phases of the two phase lixiviant. Briefly explained, the apparatus comprises an exhauster and tail pipe located below a cemented off portion of the injection pipe. Two phase lixiviant passing through the exhauster creates a reduced pressure zone in the exhauster by aspiration and then passes out into the injection interval through the tail pipe. Gas which separates from the lixiviant collects in the hole adjacent the exhauster and is drawn into the lixiviant stream. In the process of the present invention, the provision of the surfactant stabilized lixiviant substantially reduces separation of the phases and hence improves the efficiency of the leaching process.

Accordingly, it is an object of the invention to provide a process for in-situ mining of copper and nickel bearing ores of the type which have naturally occurring microscopic fractures therein and which contain sulfidic minerals which must be oxidized before being leached.

Another object of the invention is to provide a process utilizing a lixiviant having gaseous oxygen containing bubbles small enough to penetrate microscopie fractures found within ores of the type described.

Still another object of the invention is to provide a process utilizing a lixiviant containing oxygen bubbles less than about 10 microns in size.

Another object of the invention is to provide an in-situ mining procedure which omits the step of rubblizing the ore in the leaching interval.

Another object of the invention is to provide a process utilizing an ammoniated leach liquor containing small bubbles of oxygen containing gas which resist coalescence to an improved degree and which thereby minimizes the formation of gas pockets in the leaching zone or interval.

Another object of the invention is to provide an economical process for obtaining copper and/or nickel from deep, subterranean or submerged deposits.

Yet another object of the invention is to leach copper using a two phase lixiviant containing a surfactant which inhibits coalescence of the phases.

DESCRIPTION OF THE PREFERRED EMBODIMENT

At the outset, the invention is described in its broadest overall aspects with a more detailed description following. According to an important aspect of the invention, it has been found that in-situ mining of copper and nickel values is possible in deep ore formations of the type characterized by the presence of sulfidic mineral and by natural microscopic fracture openings, without rubblizing, if a stabilized, two-phase lixiviant comprising an aqueous ammoniacal leach liquor and a multiplicity of oxygen containing bubbles having a size sufficient to pass through the fracture openings in the formation is employed. According to another aspect of the invention, it has been discovered that a large number of surfactants which are available commercially, when added in a effective amount (usually about 5 to 200 parts per million) to the aqueous phase of the two phase lixiviant described above, enable the production of oxygen containing bubbles of the necessary size and greatly reduce the tendency of the two phases to separate into liquid and gas phases, i.e., greatly reduces the tendency of the bubbles to coalesce.

The improved stability of the lixiviant greatly enhances the distribution of oxygen within the leaching interval and ensures delivery of the gaseous phase to the ore even at relatively low lixiviant downward linear velocity in the pipe. Accordingly, the stabilized lixiviants make possible a relatively efficient and inexpensive in-situ mining process which heretofore was believed impossible to accomplish. Furthermore, the presence of a surfactant in the lixiviant has been observed to enhance the mass transfer rate of oxygen to such ores.

Figure 1:
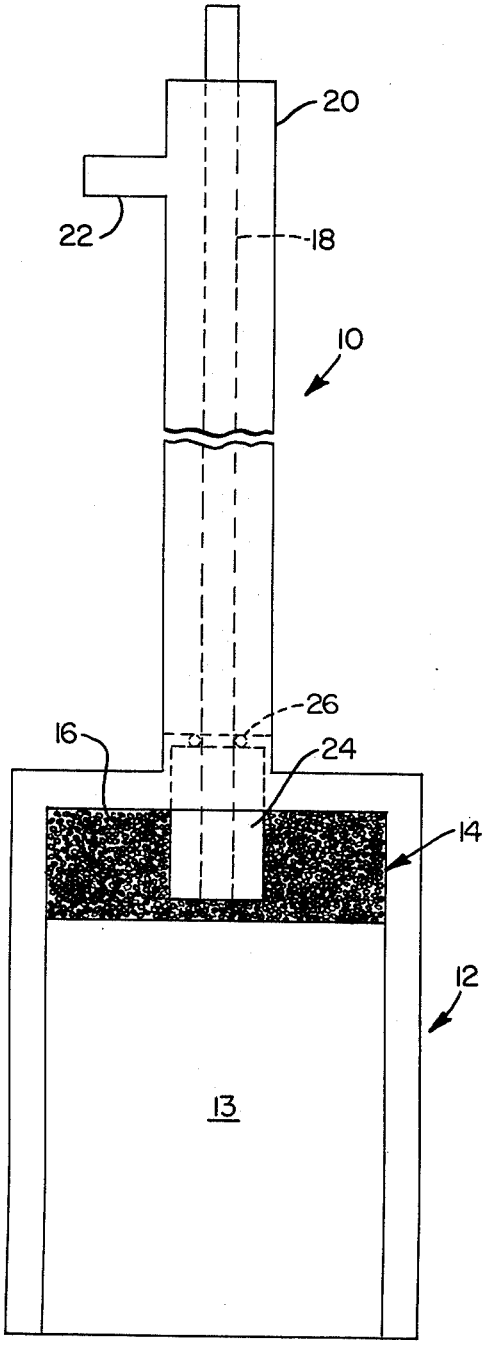
FIG. 1 is a schematic representation of laboratory apparatus for measuring the bubble size of two phase lixiviant formulations.

Referring to FIG. 1, laboratory apparatus for producing two phase lixiviants and for measuring the size of the bubbles dispersed therein is shown. The apparatus consists of sparger 10 and a bubble viewer 12. The viewer 12 comprising a clear plastic case, 0.25 inch in depth, 2.5 inches wide, and 6 inches high. The outlet of the viewer 12 (not shown) is partially submerged in a beaker full of water which keeps the viewer full of fluid during experimentation. The upper portion 14 of the viewer 12 contains a layer 16 of glass beads which reduces vortex formation while the viewer of the apparatus is filled with a lixiviant.

The sparger comprises a ¼ inch inside diameter stainless steel sintered, porous tube 18, enclosed by a pipe 20, which may be filled with pressurized gas through gas inlet 22. A PVC plug 24 sealed to the bottom of the pipe 20 by an O-ring 26 serves as an air-tight connection between sparger 10 and viewer 12.

As a modification of the apparatus of FIG. 1, a twisted stainless steel strap (not shown) having one spiral per inch may be inserted into the porous tube 18. The spiral is designed to create an angular velocity component in addition to the longitudinal velocity component, both components being the same order of magnitude.

In use, the apparatus is filled with liquid, and water or ammoniated water is introduced through the top of porous tube 18 at a given flow rate. Gas (nitrogen, air, oxygen, or oxygen enriched air) is introduced through gas inlet 22 under pressure and thereby forced through the porous walls of tube 18. The gas may also include various gaseous oxidants comprising acid forming gases such as $SO_2$, $SO_3$, or $NO_2$. The gas bubbles produced within the tube 18 are then sheared from the interior walls of tube 18 and carried through plug 24 and glass beads 16 into the viewing area 13 of viewer 12 by the liquid flow. Using this procedure and apparatus, it is possible to study the effects of various parameters on the bubble size and stability of lixiviants produced, e.g., the effect of the gas flow rate, liquid flow rate, inclusion of the spiral, and the inclusion of various additives combined with the liquid phase of the lixiviants. The object of the experiments was to produce a stable, two-phase lixiviant which could be delivered to the leaching interval of an in-situ mine at a reasonable flow rate without phase separation. In this regard, it has been discovered that the success of such lixiviants in in-situ mining techniques depends on the size of the gas bubbles being generally about 10–100 microns.

The size of a single gas bubble, in general, can be determined quite easily from its ascending velocity in a fluid of known viscosity. However, the apparatus of FIG. 1 was developed since there was no established method for measuring the size of large numbers of gas bubbles in the fluid. The size of bubbles present in the viewing area 13 of the apparatus of FIG. 1 may be easily determined if a photograph is taken of viewing area 13. The photographic method was employed because it was both direct and simple.

From a series of experiments on various lixiviants produced using the apparatus of FIG. 1, a lixiviant has been developed which makes the in situ mining of the type described above more efficient. Specifically, the addition of an effective amount of one or more surfactants to the aqueous phase of the two-phase lixiviants produced enabled the production of bubbles of the desired size range and substantially reduced coalescence of bubbles. With a surfactant, the size of the bubbles are within the range of 0.1 to 0.5 mm (lixiviant at atmospheric pressure). Without a surfactant, two-phase lixiviants produced under identical conditions have a bubble size range of 1.0 to 1.5 mm. In short, the addition of the surfactant yields a 3 to 15 times improvement in gas bubble size distribution in the low pressure simulator of FIG. 1. These results have been observed to be reproducible and even improved upon in commercial embodiments of the lixiviant production apparatus of the type described in the aforementioned U.S. applications Ser. Nos. 724,548 and 724,549. Further, some attempts at in-situ mining operations which failed when conventional two-phase lixiviants were employed because of the formation of debilitating gas pockets, were rendered successful by using the modified process of the instant invention employing the surfactant stabilized lixiviant.

With conventional two phase lixiviants, the minimum liquid downward velocity of the lixiviant is about one foot per second. At slower velocities, pockets of gas tend to form and the upward rise of the bubbles exceeds the downward flow of the liquid. However, the addition of as little as 25 parts per million surfactant in the lixiviant reduces the minimum downward velocity of the liquid phase by a factor between about 3 and 5.

The exact nature of the surfactant useful in the lixiviant compositions of the invention is not particularly critical. A surfactant sold under the tradename Dowfax 2A1 by Dow Chemical Company has been found satisfactory. Dowfax 2A1 surfactant is an anionic surface-active agent of the sulfonate type. In the dry state, it is a light-colored, free-flowing powder containing a minimum of 90 percent active ingredient. The solution form is a clear, light yellow liquid having a minimum active concentration of 45 percent. The product is the sodium salt of dodecylated oxydibenzene disulfonate having the formula

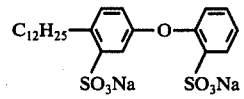

The selected surfactant should have good wetting ability on mineral surfaces. However, it should not impair the mass transfer rate of the oxygen (or other oxidants) to the mineral surface. Furthermore, the surfactant should not interfere with the reactions which take place. Non-limiting examples of useful surfactants include anionic surfactants such as carboxylates, sulfonates, sulfates, and phosphates, cationic surfactants such as primary, secondary, and tertiary amines and quaternary ammoniums, and nonionic surfactants such as the type having hydroxyl solubilizing groups. Polyoxyethylene chaigs are also useful with the invention as are amphoteric surfactants made from combinations of anionic and cationic moieties.

A broad disclosure of surface active agents is found in U.S. Pat. Nos. 3,249,465 and 3,318,817. Nonlimiting examples of carboxylates include N-acrylsarcosinates and aminocaboxylates. Useful sulfonates include alkylbenzenesulfonates, petroleum sulfonates, sulfosuccinates, naphthalenesulfonates, N-acyl-N-alkyl taurates, 2-sulfoethyl esters of fatty acids, and olefin sulfonates. Sulfates and sulfated product type anionic surfactants include sulfated alcohols, natural fats and oils, oleic acids, alkanolamides, and esters, and further include ethoxylated and sulfated alkylphenols, and ethoxylated alcohols. Phosphate esters are also useful.

Anionic sulfates include alkylbenzenesulfonates and LAS, a sodium salt of linear dodecylbenzenesulfonate.

Further, petroleum sulfonates produced as byproducts of refining certain petroleum products such as substances known as green soap and mahogany soap are also useful. Useful dialkyl sulfosuccinates include sodium di(2 ethyl hexyl) sulfosuccinates, available commercially from American Cyanamide. Useful naphthalenesulfonates include salts of alkylnaphalene sulfonates, sulfonated formaldehyde, naphthalene condensates, naphthlenesulfonates, and tetrahydronaphthalenesulfonates. Further, 2-sulfoethylesters of fatty acid are useful. Useful nonionic surfactants include such compounds as ethoxylated alkyl phenols, ethoxylated aliphatic alcohols, carboxylic esters, glycerol esters, polyethylene glycol esters, and anhydrosorbital esters.

Suitable surfactants are available commercially under the following tradenames.

| | |
|---|---|
| Anionic | |
| Union carbide | |
| Tergitol 7 | Sodium Heptadecyl Sulfate |
| Tergitol 8 | Sodium 2-Ethylhexyl Sulfate |
| Arco Chemical Co. | |
| Ultrawet 60L | Triethanolamine Linear Alkylate-Sulfonate |
| Ultrawet 30 DS | Sodium-Linear Decyl-Benzene Sulfonate |
| Dow Chemical Co. | |
| Dowfax 3B2 | Disodium 4 Decylated Oxy-Di-Benzene Di Sufonate |
| Nonionic | |
| Union Carbide | |
| Tergitol NP44 | Alkylphenyl-Hydroxpoly-oxyethylene |
| GAF | |
| Alipal Co-436 | Alkylphenoxypoly(ethyleneoxy) Ethanol |

It is preferred that the lixiviant also contain an agent which enhances the stabilization of $Ca^{++}$ ions in solution since these are often found together with the metal values of interest. The use of such an agent, however, is conventional in the oil drilling art to inhibit scale formation. A suitable $Ca^{++}$ ion stabilizer is Calnox® which is a sodium polyacrylate sold by the Atlas Powder Co. In general, other sodium polyacrylates can be used as scale inhibitors. It should be noted that the inclusion of an agent such as Calnox® in the lixiviant is not considered to be a part of the invention.

The amount of surfactant added per volume of liquid phase of the lixiviant will vary with the particular surfactant used. Successful lixiviant compositions have been made which include only 25 ppm Dowfax and mixtures of 25 ppm Dowfax with 75 ppm Calnox®. As an additional bubble coalescent inhibitor, aluminum ions in the form of 1–2 grams per liter $Al_2(SO_4)_3$ has been found to be effective.

The advantages and features of the process of the invention will be further understood from the following examples, which in no event should be construed as limiting.

EXAMPLE 1

Effect of Liquid Velocity in Porous Tube

Experiments were carried out with a constant gas flow rate of 700 standard cubic centimeters per minute (SCCM) for various liquid flow rates. At high flow rate-low gas volume fraction, the gas is well dispersed in solution. As the liquid flow rate decreases, the volume fraction of gas increases and the flow gradually changes from bubbly flow to slug flow, i.e., large amoebalike bubbles are formed. As the liquid flow rate is decreased, there is a transition where large agglomerated gas bubbles are formed having a non-spherical shape in excess of 5 ml in size.

The estimated bubble size, as a function of linear velocity in the porous tube and as measured by photographic methods using the apparatus of FIG. 1, is given in Tables 1 through 3. It is abundantly clear that the greater the liquid velocity, the smaller the gas bubble size range.

Table 1

Estimated Bubble Size, No Surfactant, With Spiral

| Run # | Liq flow rate (GPM) | linear velocity (ft/sec) | gas volume fraction % | Bubble Sizes (mm) |
|---|---|---|---|---|
| 424-1 | 4.8 | 31.4 | 3.7 | 0.5–1.5 |
| -2 | 3.15 | 20.6 | 5.5 | 1.0–1.5 |
| -3 | 2.2 | 14.4 | 7.7 | 2.0–5.0 |
| | | | | Transition |
| 427-16 | 3.75 | 24.5 | 4.7 | 0.5–1.5 |
| -17 | 3.15 | 20.6 | 5.5 | 1.0–2.5 |
| -18 | 2.48 | 16.2 | 6.9 | 1.0–3.0 |
| -19 | 2.2 | 14.4 | 7.7 | 2.0–5.0 |
| | | | | Transition |

Table 2

Estimated Bubble Size, With Dowfax, No Spiral In Porous Tube

| Run # | Liq flow rate (GPM) | linear velocity (ft/sec) | gas volume fraction % | Bubble Sizes (mm) |
|---|---|---|---|---|
| 419-1 | 3.65 | 23.9 | 4.8 | 0.1–0.5 |
| -2 | 4.05 | 26.5 | 4.4 | 0.1–0.5 |
| -3 | 3.15 | 20.5 | 5.5 | 0.1–0.5 |
| -4 | 2.65 | 17.3 | 3.8 | 0.2–0.6 |
| -5 | 2.15 | 14.1 | 7.9 | 0.25–1.0 |
| -6 | 1.8 | 11.8 | 9.3 | 0.2–2.0 |
| -7 | 1.6 | 10.5 | 10.4 | 0.2–3.0 |
| -8 | 1.5 | 9.8 | 11.0 | 0.2–4.0 |
| | | | | Transition |

Table 3

Estimated Bubble Size, With Dowfax, With Spiral In Porous Tube

| Run# | Liq flow rate (GPM) | linear velocity (ft/sec) | gas volume fraction % | Bubble Sizes (mm) |
|---|---|---|---|---|
| 425-4 | 4.8 | 31.4 | 3.7 | 0.1–0.5 |
| -5 | 4.1 | 26.0 | 4.3 | 0.1–0.5 |
| -6 | 3.15 | 20.6 | 5.5 | 0.2–0.6 |
| -7 | 2.2 | 13.7 | 7.7 | 0.2–0.75 |
| -8 | 1.25 | 8.2 | 12.9 | 1–2.5 |
| | | | | Transition |
| -9 | 0.60 | 3.9 | 23.5 | 2–5.0 |
| 426-11 | 3.75 | 24.5 | 4.7 | 0.1–0.5 |
| -13 | 3.15 | 20.6 | 5.5 | 0.2–0.6 |
| -14 | 2.2 | 14.4 | 7.7 | 0.3–0.75 |
| -15 | 1.25 | 8.17 | 12.9 | 0.5–2.0 |
| | | | | Transition |

EXAMPLE 2

The Effect of Surfactant Addition

As can be seen from a comparison of Tables 1 and 2 above, the bubble size range is significantly smaller in lixiviant containing a surfactant versus a lixiviant without a surfactant. The bubble size range in lixiviants containing a surfactant, as exemplified by a comparison between the 3.5 gpm flow rate, are in the range of 0.1 to 0.5 mm, whereas, without a surfactant, the range is between 1.0 and 1.5 mm. It is estimated that the addition of an effective amount of surfactant reduces bubble size by a factor of 15.

EXAMPLE 3

The Effect of Inclusion of a Spiral Strap

A twisted stainless steel strap having one spiral per inch was inserted into the interior of porous tube 18 to create an angular velocity component in addition to the longitudinal velocity component. By comparing the results disclosed in Table 2 with those of Table 3, it can be seen that the spiral can reduce the transition flow rate from 1.5 gpm to 1.25 gpm. However, no noticeable effect on bubble size was observed.

The separation of the gaseous and liquid phases in the field at the injectin interval seriously reduces the leaching efficiency and oxygen utilization. The following examples disclose laboratory data which demonstrate the improvement in stability of the lixiviant useful in the process of the invention as compared to conventional two-phase lixiviants containing no surfactant.

Figure 2:
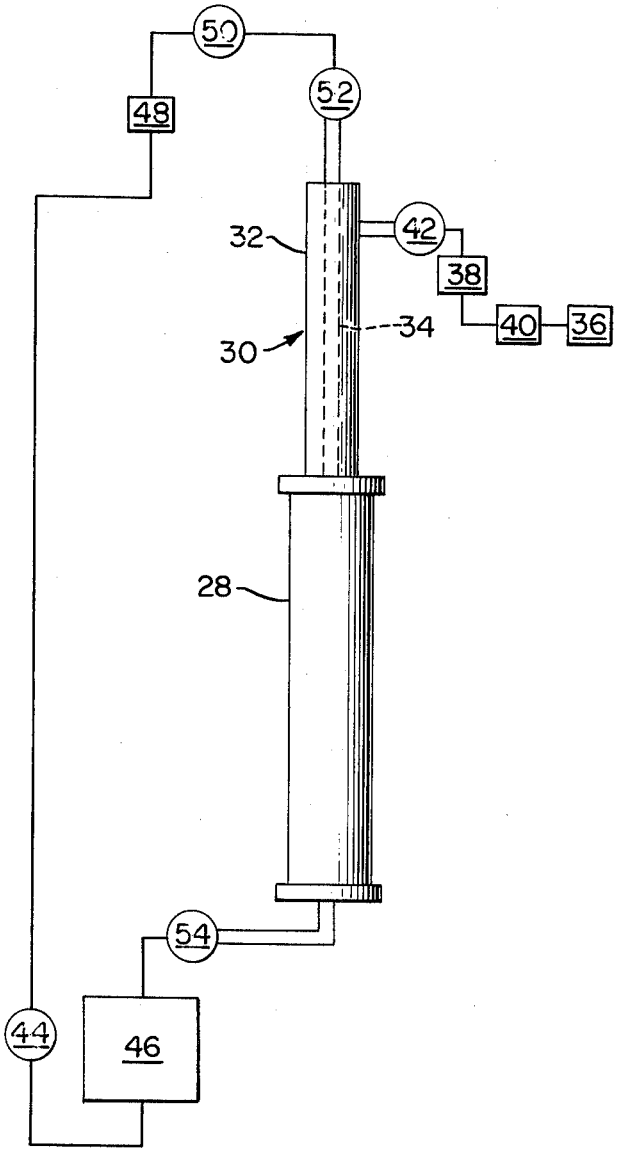
FIG. 2 is a schematic diagram showing laboratory apparatus for testing the stability, under various conditions, of two phase lixiviants.

FIG. 2 shows laboratory apparatus designed to measure and compare the stability of various lixiviant formulations. The apparatus comprises a 2-inch inside diameter clear plastic tube 28, 18 inches long, the upper end of which is attached to a sparger unit 30. The sparger unit 30 comprises a pair of coaxial pipes 32, 34 for producing the two-phase lixiviants. Pipe 34 is porous (sintered metal) and carries the liquid phase of the lixiviant which, within sparger 30, is filled with gas bubbles formed when gas passes from reservoir 36 into pipe 32, under pressure, and through the wall of pipe 34. The rate of gas flow, in ml/min., is monitored by flow meter 38. In addition, the mass of gas entering tube 32 per unit time may be monitored by mass flowmeter 40. A solenoid valve 42 is provided in the gas feed line.

The liquid phase of the lixiviant is pumped at various flow rates by a variable speed gear pump 44 from reservoir 46. Its flow rate is monitored by flowmeter 48. A pressure gage 50 serves to display the pressure of the liquid phase during operation of the apparatus and at a time after shut down. Solenoid valves 52, 54 are designed to operate synchronously together with valve 42. A T.V. camera, monitor, and video tape deck equipped with a slow motion and frame stopping feature were used during all experiments so that precise measurements could be taken after performance of the experiments.

A typical run started with mixing gas and liquid at the sparger 30. The mixture was allowed to flow through tube 28 for 15 minutes to achieve steady state, and thereafter, solenoid valves 42, 52, and 54 were closed simultaneously. At the same time, a precision timer (not shown) was actuated.

Figure 3:
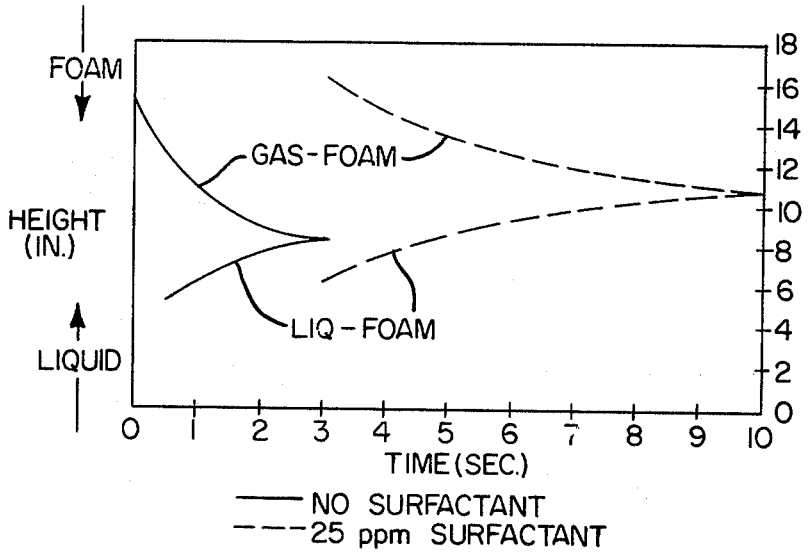
FIGS. 3–6 are graphs made from data derived from experiments conducted using the apparatus of FIG. 2.

Upon shut off of the valves, gas bubbles begin to rise in the tube 28. Larger bubbles rise faster than small ones. When the gas bubbles reach the gas-liquid interface faster than they break away, a third phase, the foam phase, is created. As time goes on, the foam-liquid interface builds up and the foam-gas interface moves down. FIG. 3 is a plot of fluid interface changes as a function of time comparing a run using a lixiviant containing no surfactant to one using 25 ppm surfactant. As can be seen from FIG. 3, the inclusion of a surfactant increases the time necessary for separation of the phases by a factor of three, and, in addition, reduces the total amount of gas accumulated in the flow tube as evidenced by the higher final liquid-gas interface level.

Figure 4:
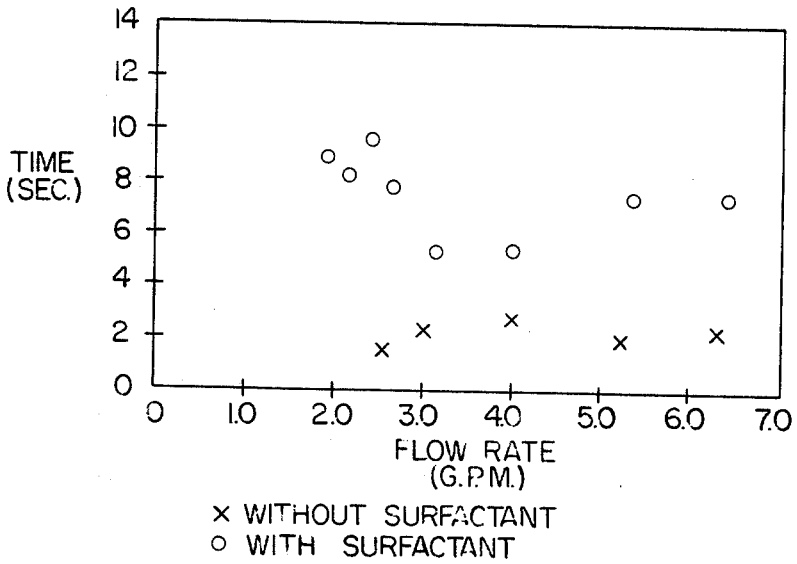

Because of the asymptotic nature of the curves, separation time was defined as the time when the liquid foam interface reached 95% of its final height. FIG. 4 is a plot of separation time as a function of liquid flow rate which compares the stability of lixiviants with and without added surfactant. The results indicate that the separation time is not a simple function of flowrate, but that, in the presence of a surfactant, the separation time is generally 4–5 times longer than in its absence. This means the average bubble size is 16–25 times smaller in the surfactant solutions.

Figure 5:
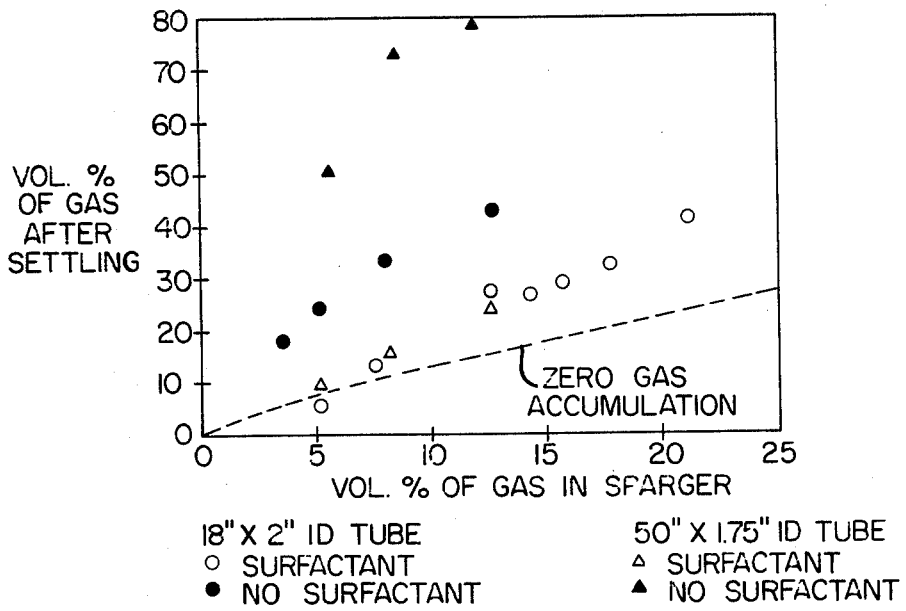

After the gas is totally separated from the liquid, the volume fraction of gas in the tube 28 is calculated from the height of the interface and the tube pressure. This volume fraction is compared with the sparger volume fraction, as calculated from the gas and liquid flow rate, in the graph of FIG. 5. As can be seen from FIG. 5, the addition of a surfactant to the lixiviant effectively reduces gas accumulation in the tube. Apparently accumulation takes place only during the first few minutes of the run, since prolonging the flow of the two phase mixture from 15 minutes to 2 hours has no effect on the total gas accumulation.

Figure 6:
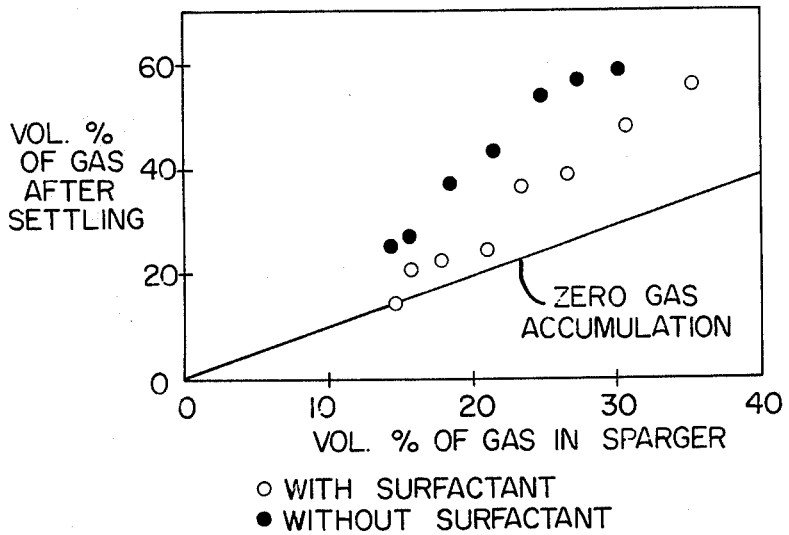

Experiments were also conducted to study the effect of reducing the void space within tube 28 to simulate underground leaching interval conditions. Tube 28 was filled with 7/16 in. diameter $Al_2O_3$ spheres to reduce the void space and thereby increase creeping velocity. Results of experiments using the apparatus of FIG. 2 with this modification show that the separation time increases by a factor of 10 (see FIG. 6 for interface-time curves) and that gas accumulation is further reduced in the tubes.

To test the effect of lengthening of tube 28, runs were conducted using the apparatus of FIG. 2 except that a 50 inch, 1.75 I.D. tube was used in place of tube 28. Based on these experiments, the separation time was found to be proportional to the tube length. The volume fraction of gas accumulation was not affected by tube length for lixiviants embodying the invention (see open triangles of FIG. 5). However, for lixiviants containing no surfactant, the flow was very unstable and large gas accumulations resulted (see solid triangles of FIG. 5).

EXAMPLE 4

To illustrate the effectiveness of the process of the invention employing a lixiviant of the type set forth above, a leaching test was carried out in a copper mineral deposit, consisting chiefly of chalcopyrite, having an average grade of copper of 0.45% and an ore body porosity of approximately 3%. No rubblizing was conducted. As set forth in the flow sheet illustrating the process (FIG. 7), the aqueous phase of the lixiviant was made from 1 M $NH_3$, 0.25 M $(NH_4)_2SO_4$, 25 parts per million Dowfax,® and 75 parts per million Calnox®. This phase was injected into the leaching interval of the ore body at a rate of 10 gallons per minute after being mixed with 12 standard cubic feet per minute gaseous oxygen utilizing a stainless steel sparger of the type set forth in the aforementioned U.S. application Ser. No. 724,549, i.e., a commercial embodiment of a sparger comprising a sintered metal porous tube such as that briefly described herein. The two-phase fluid was injected under pressure into the leaching interval through a tailpipe extending to 3160 feet. Downward fluid velocity in the 1.5 inch pipe was 1.8 feet per second.

Pregnant solution was recovered at a rate of 10 gallons per minute from a production well located 70 feet from the injection well. Forty-five days later, the recovered solution contained 0.71 g/l copper, 0.66 M $NH_3$, 0.25 M $(NH_4)_2SO_4$, 0.04 M $CaSO_4$, 20 ppm Dowfax,® and 50 ppm Calnox.®

Figure 7:
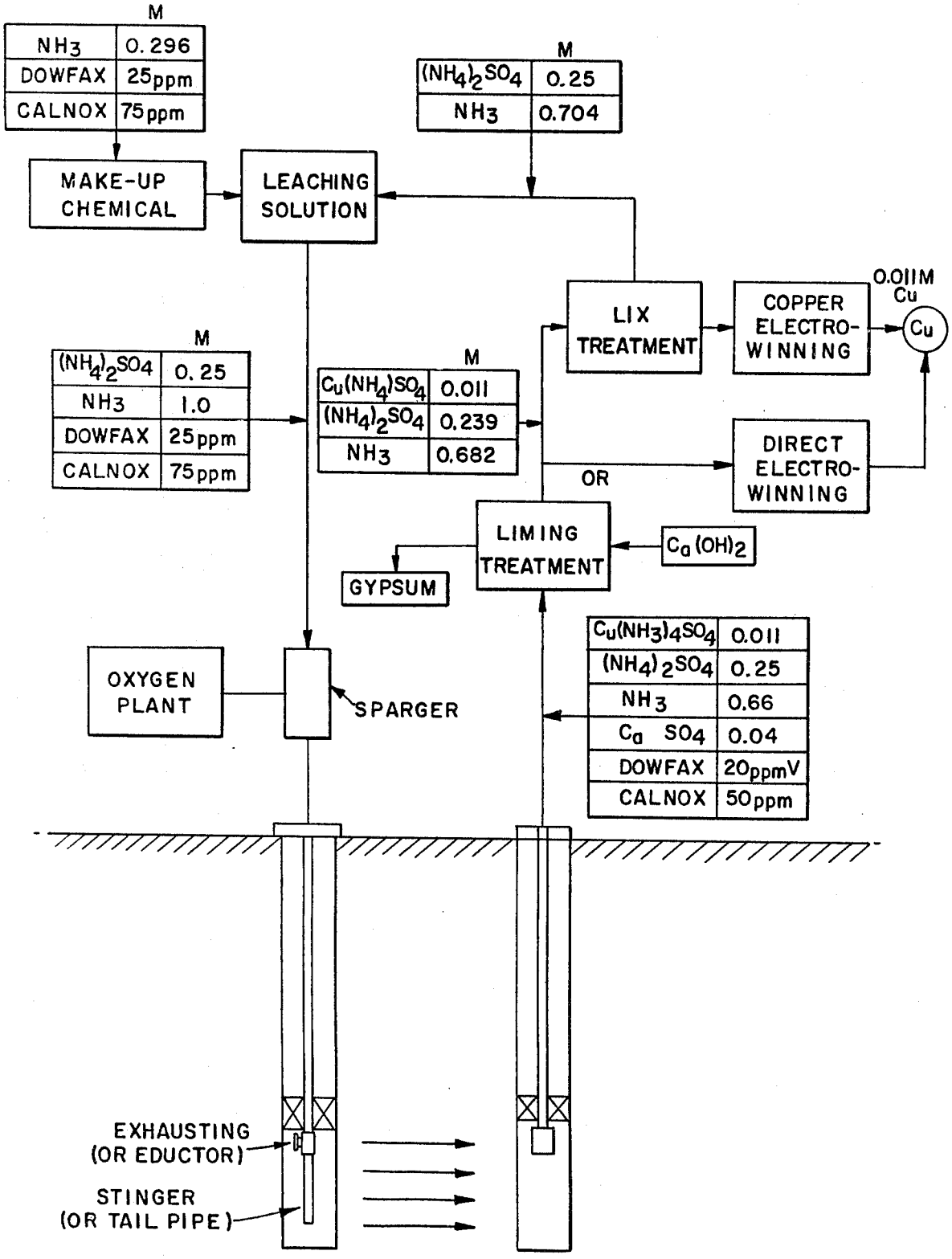
FIG. 7 is a schematic diagram illustrating one embodiment of the process of the invention.

As part of the $(NH_4)_2SO_4$ was treated with lime to regenerate the ammonia and also to remove the $CaSO_4$ from the solution. The copper was then extracted by electrowinning and the raffinate of the extraction was recycled with addition of make up chemicals as indicated in FIG. 7.

In one important embodiment of the process of the invention, as set forth in the example above, the aqueous phase of the lixiviant comprises an ammoniacal solution and the gaseous phase comprises oxygen. During leaching, the following reactions are believed to occur:

$$4\ CuFeS_2 + 17\ O_2 + 6H_2O + 24\ NH_3 \rightarrow 4\ Cu(NH_3)_4SO_4 + 4FeOOH + 4\ (NH_4)_2SO_4 \quad (1)$$

$$4FeS_2 + 15O_2 + 10H_2O + 16NH_3 \rightarrow 4FeOOH + 8(NH_4)_2\ SO_4 \text{ (a possible undesirable side reaction)} \quad (2)$$

Of course, nickel, cobalt and molybdenum, if present as sulfides in the ore will also be leached in accordance with known chemistry. At this point, it should be noted that the primary purpose of the oxygen is to break the chemical bonds holding the copper in the chalcopyrite by oxidizing the sulfide and iron components. Once the chalcopyrite is oxidized, the aqueous ammonia is able to dissolve the copper values. It makes no difference whether or not the copper is oxidized. Indeed it is believed that the $CuFeS_2$ contains copper as cupric copper and iron as ferrous iron. Thus, during oxidation in accordance with the foregoing reaction, the oxidation state of copper remains unchanged while the iron is oxidized from $Fe^{+2}$ to $Fe^{+3}$. Of course, if $Cu^{+}$ copper is present in the ore, it would also be leached by the lixiviant. Since both forms of copper ions are leachable, it is not necessary to oxidize cuprous ions to cupric ions in order to leach copper.

A sufficient excess of aqueous ammonia is used to keep the pregnant solution alkaline. Under these conditions, dissolution of gangue materials is negligible and the pregnant solution contains essentially only ammonia, ammonium sulfate, and cupric ammine sulfate.

It is to be understood that the process of the invention can be employed with aqueous phases other than ammoniacal solution. The oxygen-ammonia lixiviant is preferred where there is a lot of acid-consuming minerals in the ore body. However, a representative example of another two-phase system that can be used to leach copper and nickel from a sulfate deposit includes the so-called oxygen-water lixiviant.

The chemistry for the oxygen-water lixiviant appears below.

$$4CuFeS_2 + 17\ O_2 + 6\ H_2O \rightarrow 4\ CuSO_4 + 4\ FeOOH + 4\ H_2SO_4$$

$$4\ FeS_2 + 15\ O_2 + 10\ H_2O \rightarrow 4\ FeOOH + 8\ H_2SO_4$$

When an oxygen-water lixiviant is used, cupric sulfate and sulfuric acid are generated in the leaching process or added on the surface. The cupric sulfate and sulfuric acid dissolve gangue metal oxides (Fe, Mg, Al, Ca, etc.) as sulfates. Much of the iron and aluminum precipitates in-situ as jarosite and alunite. In the surface plant, copper is extracted, and if necessary, the pH is adjusted to the desired level. The resulting leach solution is reinjected together with make-up oxygen. Another name for the oxygen-water lixiviant is the oxygen-acid lixiviant.

The process of the present invention is used to great advantage for deep-lying ore bodies, that is, ore bodies located at a depth of 1,000 feet or more below the surface. Although, the surface is normally a land surface, it should be noted that there is no reason why this process cannot be used to recover copper from deposits located below the bottom of the continental shelf or a lake bed. Thus, when reference is made to the depth of deposit below the surface, the surface can either be land surface or water surface.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A process for the in-situ mining of metal values selected from copper, nickel or mixtures thereof from a subterranean ore body characterized by natural microscopic fracture openings, a portion of said body being a sulfidic ore, said process being characterized by the steps of:

a. drilling at least one injection hole and at least one production hole communicating with said ore body;

b. forming a stable, two-phase lixiviant comprising an aqueous phase, a multiplicity of gaseous, oxygen containing bubbles having a size, when subjected to the pressure employed during in-situ mining, sufficient to pass through the fracture openings in said ore body, and a surfactant for maintaining the size and individuality of said bubbles;

c. forcing the lixiviant formed in step (b), under pressure, through said ore body to cause the lixiviant to penetrate the ore body through the natural microscopic fracture openings, the oxygen in said lixiviant reacting with the sulfide in the ore to enable metal ions to be solubilized by said aqueous phase;

d. withdrawing the resultant metal bearing aqueous phase to the surface through said production hole; and e. recovering metal values from said aqueous phase.

2. The process as set forth in claim 1 wherein the metal barren aqueous phase produced in step (e) is returned to the ore body through an injection hole.

3. The process as set forth in claim 1 wherein the ore body is a porphyry copper ore body in which copper bearing minerals occur in disseminated grains.

4. The process as set forth in claim 1 wherein the ore body comprises chalcopyrites.

5. The process set forth in claim 1 wherein said aqueous phase comprises an ammoniated leach liquor.

6. The process as set forth in claim 1 wherein said forming step is effected as follows:

1. supplying said aqueous phase containing said surfactant to the interior of a porous tube formed of sintered powdered metal;
2. supplying said oxygen containing gas to the exterior of said tube under pressure sufficient to cause said gas to penetrate to the interior of said tube; and 3. passing the aqueous phase supplied in step 1 through said tube to cause said aqueous phase to shear gas bubbles from the interior thereof.

7. The process as set forth in claim 6 wherein said forming step is effected above ground.

8. The process as set forth in claim 6 wherein said surfactant is selected from nonionic surface active agents and anionic surface active agents.

9. The process as set forth in claim 6 wherein said surfactant is the sodium salt of dodecylated oxydibenzene disulfonate.

10. The process as set forth in claim 9 wherein said sodium salt of dodecylated oxydibenzene disulfonate has the following formula

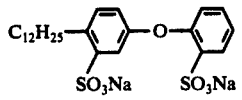

11. The process as set forth in claim 10 wherein said surfactant is present in the lixiviant in an amount between the range of 5–200 ppm.

* * * * *